US006582018B2

(12) United States Patent
Tseng

(10) Patent No.: US 6,582,018 B2
(45) Date of Patent: Jun. 24, 2003

(54) SWING FRAME FOR HANGING A SWING CHAIR

(75) Inventor: Chuen-Jong Tseng, Chiayi Hsien (TW)

(73) Assignee: Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 09/978,863

(22) Filed: Oct. 16, 2001

(65) Prior Publication Data

US 2003/0071499 A1 Apr. 17, 2003

(51) Int. Cl.[7] ..... A47D 13/10

(52) U.S. Cl. ..... 297/281; 297/280; 297/273; 297/271

(58) Field of Search ..... 297/281, 280, 297/273, 277; 472/118, 125; 248/146, 150, 151

(56) References Cited

U.S. PATENT DOCUMENTS 5,564,987 A * 10/1996 Ayrolles ..... 472/118
5,803,818 A * 9/1998 Tseng ..... 472/118
5,876,289 A * 3/1999 Liu ..... 472/118
6,036,605 A * 3/2000 Tseng ..... 472/118
6,402,233 B1 * 6/2002 Tseng ..... 297/184.1

* cited by examiner

*Primary Examiner*—Peter M. Cuomo
*Assistant Examiner*—Erika Garrett
(74) *Attorney, Agent, or Firm*—Ladas & Parry

(57) ABSTRACT

A swing frame includes a pair of support frame units, a hollow horizontal bar, and two primary locking devices. Each of the support frame units includes upper, lower, and intermediate portions. The upper portion is formed with a horizontal hollow tube at the top end thereof. The horizontal bar has opposite end portions inserted respectively into the hollow tubes of the support frame units. The primary locking devices are disposed respectively on the end portions of the horizontal bar, thereby locking the end portions of the horizontal bar relative to the hollow tubes.

4 Claims, 5 Drawing Sheets

SWING FRAME FOR HANGING A SWING CHAIR

BACKGROUND OF THE INVENTION

1. Field of the Invention

The invention relates to a swing frame, more particularly to a swing frame having locking devices for hanging stably a swing chair.

2. Description of the Related Art

Referring to FIG. 1, a conventional swing includes a swing frame 1, a cover frame 2, and a swing chair 3 hung on the swing frame 1. The conventional swing frame 1 comprises a pair of opposite leg frame units 11, a top horizontal bar 12 connected between the leg frame units 11, and a pair of vertical connecting sleeves 121. Each leg frame unit 11 has a front leg rod 111 and a rear leg rod 112 connected to an intermediate portion of the front leg rod 111 by means of screws 15 and nuts 16. Each front leg rod 111 has an open top end 113. Each of the connecting sleeves 121 is welded to a corresponding end of the horizontal bar 12, and has a lower section 122 formed with a decreasing diameter. The lower section 122 is inserted into the top end 113 of a corresponding one of the front leg rods 111, and is retained thereon by means of a pair of clamp plates 13 and a plurality of screws 17.

As mentioned above, the conventional swing frame 1 has two connecting sleeves 121 that are welded to the respective opposite ends of the horizontal bar 12 to connect with the respective leg frame units 11 by screws 15 and nuts 16. Due to the forces induced upon swinging the swing chair 3, the connection between the connecting sleeves 121 and the leg frame units 11 is liable to become loosened after using the swing frame 1 for a short period of time. Furthermore, since the front and rear leg rods 111, 112 are simply connected by welding and screw connection, when the swing frame 1 supports a heavy load, the front and rear leg rods 111, 112 are easily disintegrated.

SUMMARY OF THE INVENTION

Therefore, the main object of the present invention is to provide a swing frame having stable locking devices in order to overcome the aforementioned drawbacks of the prior art.

Accordingly, a swing frame of this invention comprises a pair of support frame units, a hollow horizontal bar, and two primary locking devices. Each of the support frame units includes an upper portion, a lower portion opposite to the upper portion, and an intermediate portion connecting the upper and lower portions. The upper portion is formed with a horizontal hollow tube at the top end thereof. The hollow horizontal bar is adapted to hang a swing chair, and has opposite end portions that are inserted respectively into the hollow tubes of the support frame units. The primary locking devices are disposed respectively on the end portions of the horizontal bar to lock the end portions of the horizontal bar relative to the hollow tubes.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
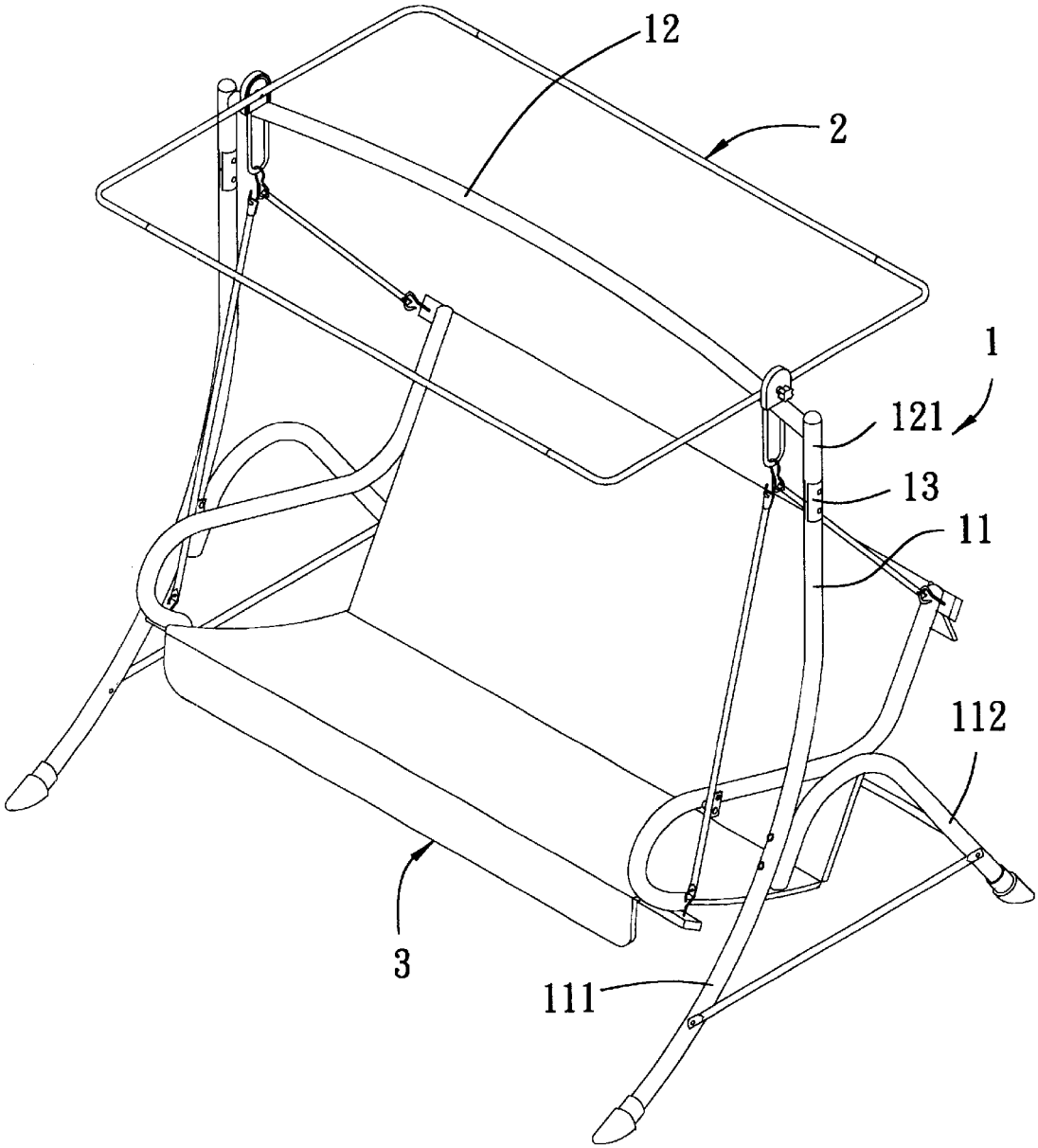
FIG. 1 PRIOR ART
FIG. 1 is a perspective view of a swing with a conventional swing frame.
Figure 2:
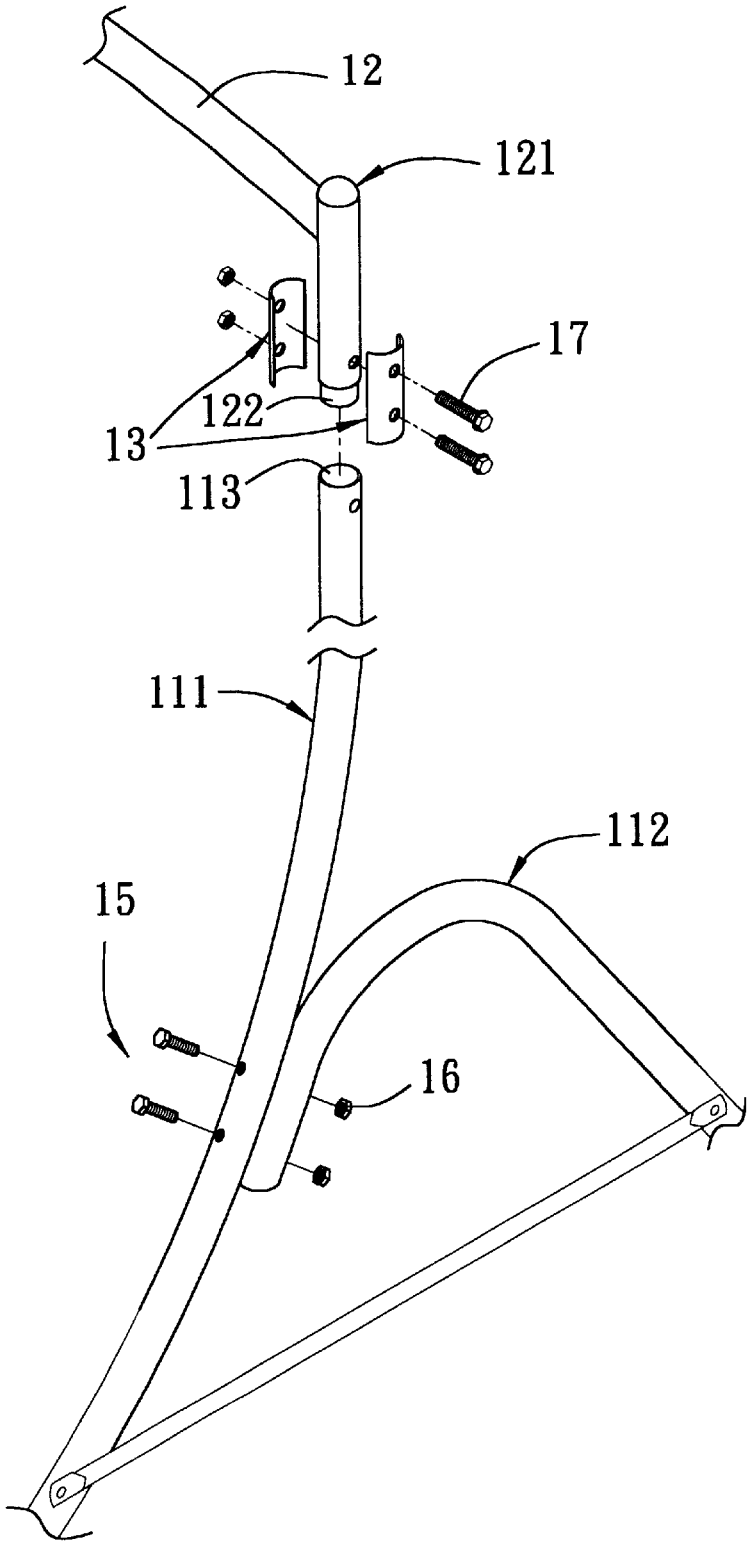
FIG. 2 PRIOR ART
FIG. 2 is an exploded fragmentary perspective view of the conventional swing frame.
Figure 3:
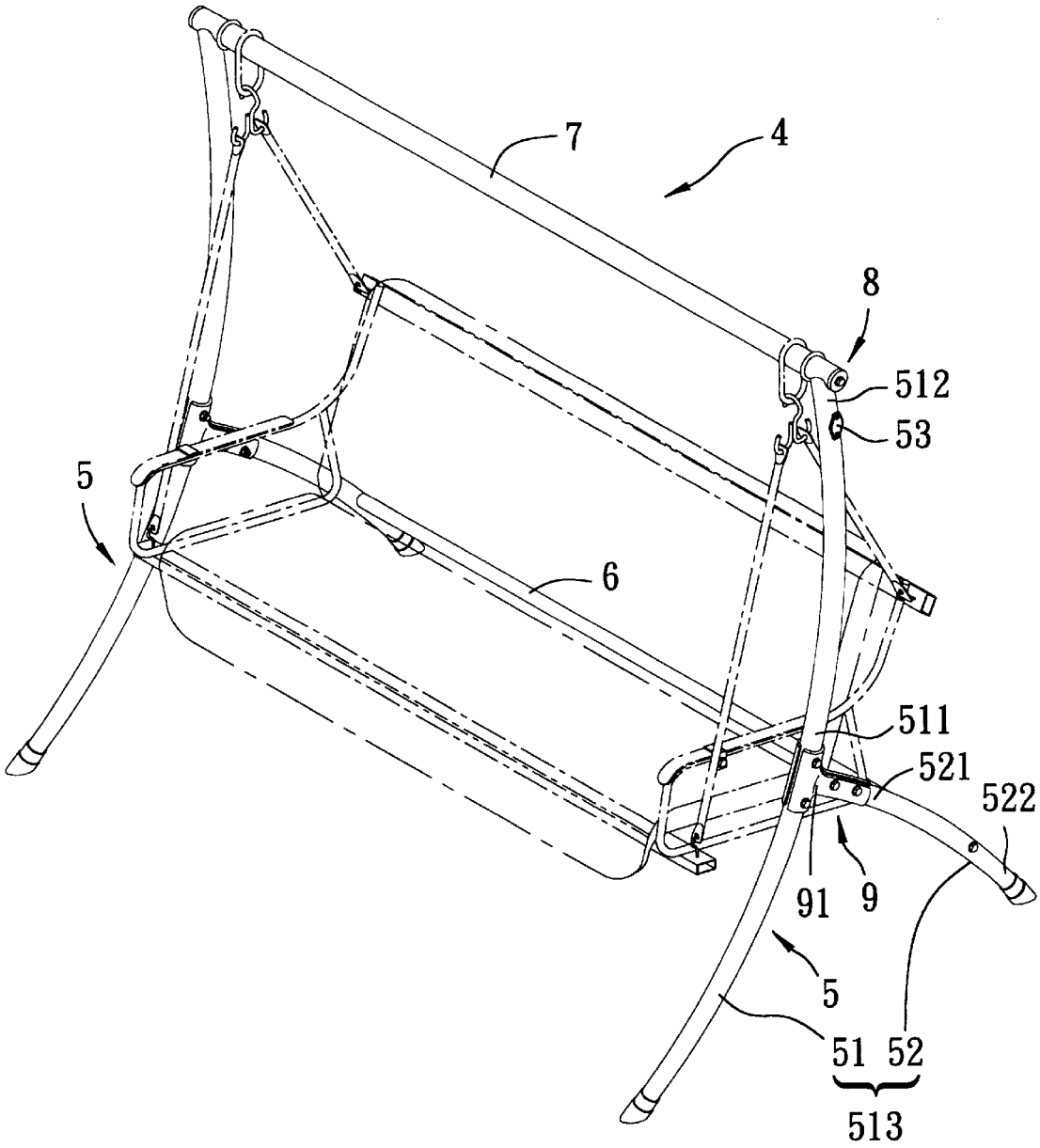
FIG. 3 is a perspective view of the preferred embodiment of a swing frame according to the present invention.
Figure 4:
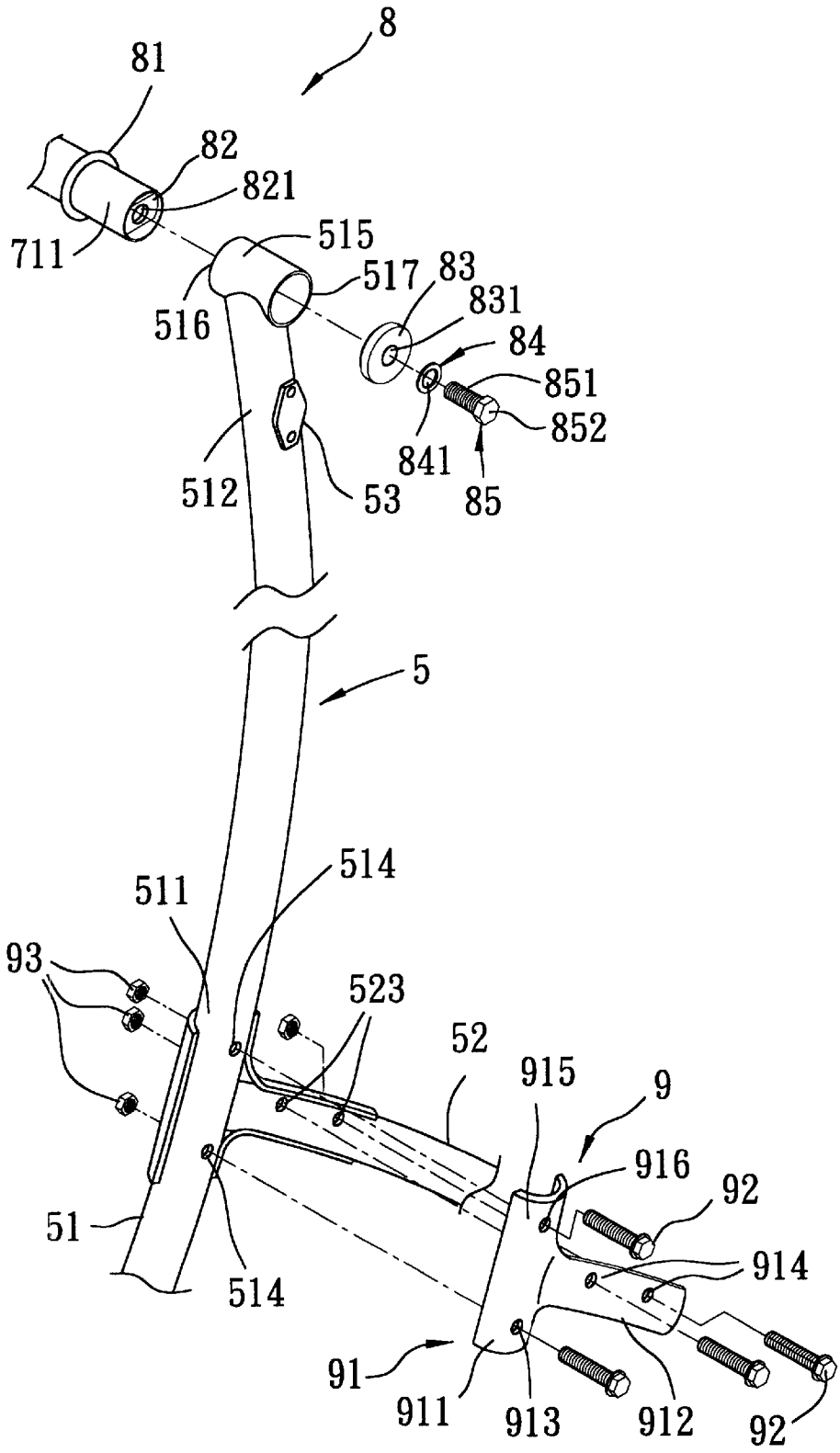
FIG. 4 is an exploded fragmentary perspective view of the swing frame of FIG. 3.

Referring to FIGS. 3 and 4, the preferred embodiment of a swing frame 4 according to the present invention is provided for hanging a swing chair (as shown in phantom lines in FIG. 3). The swing frame 4 comprises a pair of opposite support frame units 5, a base bar 6, a hollow horizontal bar 7, two primary locking devices 8, and two secondary locking devices 9. Each of the support frame units 5 is adapted to be disposed on a ground surface, and includes an upper portion 512, a lower portion 513 opposite to the upper portion 512, and an intermediate portion 511 connecting the upper and lower portions 512, 513. The upper portion 512 is formed with a horizontal hollow tube 515 at the top end thereof. The hollow tube 515 has two opposite open ends 516, 517. The upper portion 512 further has a connector 53 disposed below the hollow tube 515 for mounting a sun shade (not shown) that can be placed above the swing frame 4. Since the sun shade is not a main point of the present invention, a detailed description thereof will be dispensed with herein for the sake of brevity. The intermediate portion 511 has two pairs of diametrically opposed holes 514. Each of the support frame units 5 is bifurcated at the intermediate portion 511 to form a curved front foot rod 51 and a rear foot rod 52. The front foot rod 51 extends downwardly and frontwardly, and formed as one piece with the intermediate portion 511. The rear foot rod 52 extends downwardly and rearwardly, and is a separate piece from the intermediate portion 511. The rear foot rod 52 has an upper section 521 that is welded to a corresponding one of the intermediate portions 511 of the support frame units 5, a lower section 522 opposite to the upper section 521, and two pairs of diametrically opposed holes 523 that are disposed proximate to the upper section 521.

The base bar 6 has opposite ends that are connected removably and respectively with the lower sections 522 of the rear foot rods 52.

The hollow horizontal bar 7 is adapted to hang a swing chair and is disposed above and in parallel with the base bar 6. The horizontal bar 7 has opposite end portions 711 each including a fixed end plate 82. The end portion 711 is inserted through one end 516 of the corresponding hollow tube 515. The end plate 82 has a center screw hole 821.

Figure 5:
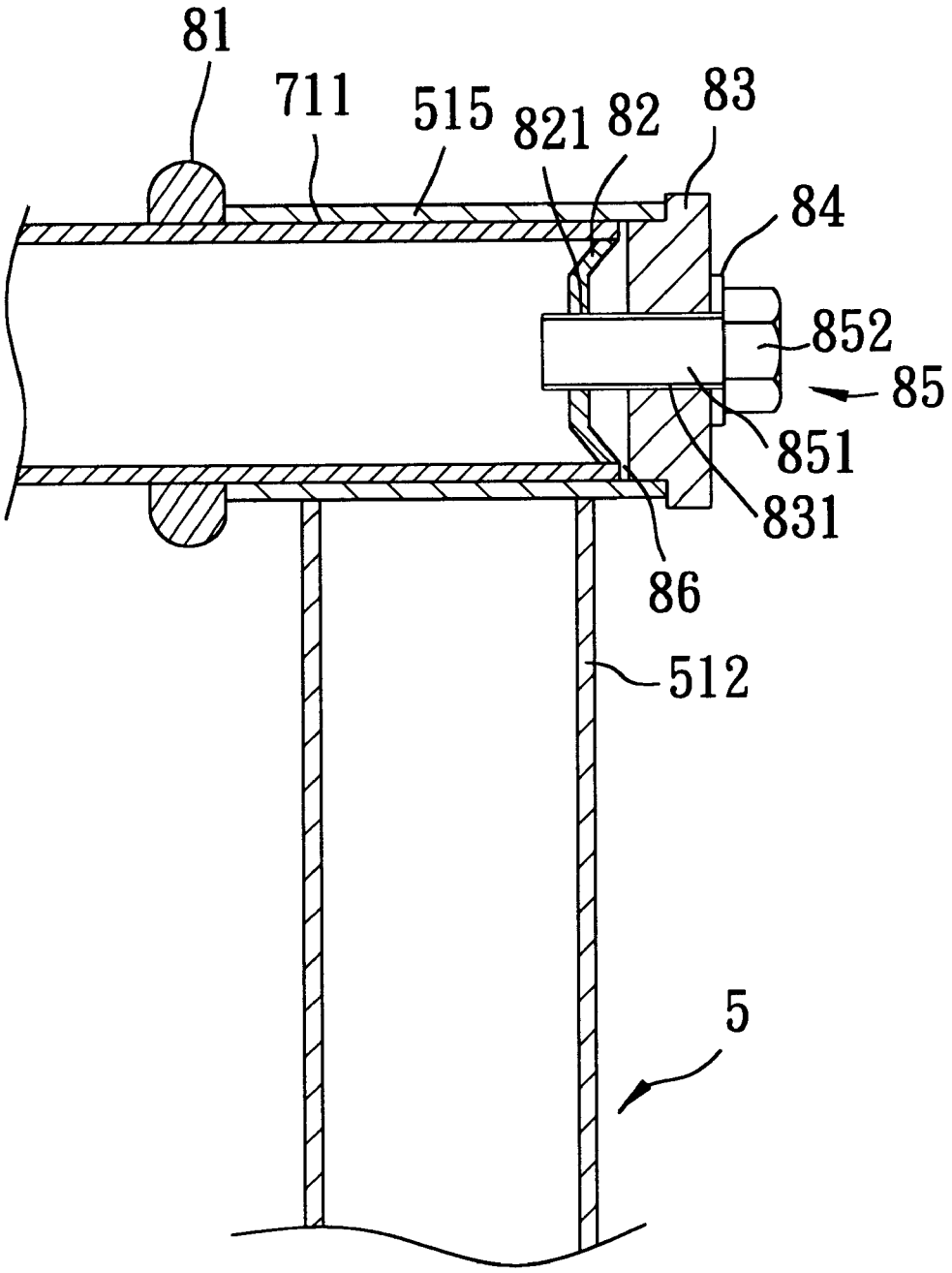
FIG. 5 is a fragmentary cross-sectional schematic view of the preferred embodiment illustrating how an end of a horizontal bar and an upper end of a front leg rod are inter-engaged.

The primary locking devices 8 are disposed respectively on the end portions 711 of the horizontal bar 7 for locking the end portions 711 of the horizontal bar 7 relative to the hollow tubes 515, and includes a limiting ring 81, a side cover plate 83, a washer 84, and a first screw unit 85. The limiting ring 81 is welded on the outer periphery of the corresponding end portion 711 of the horizontal bar 7 inwardly of the corresponding hollow tube 515. The side cover plate 83 covers the corresponding end 517 of the hollow tubes 515 outwardly of the end plate 82 of the horizontal bar 7, and has a center through-hole 831. The first screw unit 85 has a long threaded portion 851 and a head portion 852 opposite to the threaded portion 851. The threaded portion 851 of the screw unit 85 extends through a hole 841 of the washer 84, and the through-hole 831 of the side cover plate 83, and is threaded into the screw hole 821 of the corresponding end plate 82, thereby abutting the end 516 of the tube 515 against the limiting ring 81, and thereby abutting the head portion 852 against the washer 84. As such, the end portions 711 of the horizontal bar 7 are fastened securely to the respective hollow tubes 515. As shown in FIG. 5, a space 86 is formed between the side cover plate 83 and the end plate 82 of the horizontal bar 7 after each of the side cover plates 83 covers the end 517 of the corresponding tube 515.

Each secondary locking device 9 includes a pair of substantially T-shaped clamp plates 91 sandwiching and clamping the front and rear foot rods 51, 52 and the intermediate portion 511. The clamp plates 91 have two complementing upward curved plate sections 915, two complementing downward and frontward curved plate sections 911, and two complementing downward and rearward curved plate sections 912. Each of the upward curved plate sections 915 has a hole 913 in alignment with one pair of diametrically opposed holes 514 on the intermediate portions 511. Each of the downward and frontward curved plate sections 911 has a hole 916 in alignment with the other pair of diametrically opposed holes 514 on the intermediate portion 511. Each of the downward and rearward curved plate sections 912 has a pair of diametrically opposed holes 914 in alignment with the holes 523 on the rear foot rod 52. Each of the secondary locking devices 9 further has a plurality of second screw units 92 and a plurality of nuts 93. Each of the second screw units 92 extends from respective holes 913, 916, 914 on the clamp plates 91 through the respective holes 514, 523 on the intermediate portion 511 and the rear foot rod 52. The nuts 93 are attached respectively to the second screw units 92, so that the front and rear foot rods 51, 52 and the intermediate portion 511 are clamped securely together by the clamp plates 91.

In this embodiment, since the opposite ends 711 of the horizontal bar 7 are inserted into and integrally connected with the respective horizontal hollow tubes 515 at the upper portions 512 of the swing frame 4, the swing frame 4 is durable and will not become loosened after a long period of use. Furthermore, because the welded connection of the front and rear foot rods 51, 52 is reinforced with the intermediate portion 511 by clamp plates 91, a strong joint results in the swing frame 4.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A swing frame for hanging a swing chair comprising:

a pair of support frame units, each of which includes an upper portion, a lower portion opposite to said upper portion, and an intermediate portion connecting said upper and lower portions, said upper portion being formed with a horizontal hollow tube at the top end thereof;

a hollow horizontal bar adapted to hang the swing chair and having opposite end portions that are inserted respectively into said hollow tubes of said support frame units;

two primary locking devices disposed respectively on said end portions of said horizontal bar to lock said end portions of said horizontal bar relative to said hollow tubes; and wherein said end portions of said horizontal bar are respectively provided with fixed end plates to close said end portions, each of said locking devices including a pair of side cover plates respectively covering said tubes of said support frame units outwardly of said end plates, and a first screw unit extending through one of said cover plates and one of said end plates to fasten together the same.

2. A swing frame for hanging a swing chair comprising:

a pair of support frame units, each of which includes an upper portion, a lower portion opposite to said upper portion, and an intermediate portion connecting said upper and lower portions, said upper portion being formed with a horizontal hollow tube at the top end thereof;

a hollow horizontal bar adapted to hang the swing chair and having opposite end portions that are inserted respectively into said hollow tubes of said support frame units;

two primary locking devices disposed respectively on said end portions of said horizontal bar to lock said end portions of said horizontal bar relative to said hollow tubes; and wherein each of said primary locking devices further has a limiting ring, said limiting ring being disposed around a corresponding one of said end portions of said horizontal bar inwardly of the corresponding one of said hollow tubes, each of said hollow tubes having one end abutting against said limiting ring.

3. A swing frame for hanging a swing chair comprising:

a pair of support frame units, each of which includes an upper portion, a lower portion opposite to said upper portion, and an intermediate portion connecting said upper and lower portions, said upper portion being formed with a horizontal hollow tube at the top end thereof;

a hollow horizontal bar adapted to hang the swing chair and having opposite end portions that are inserted respectively into said hollow tubes of said support frame units;

two primary locking devices disposed respectively on said end portions of said horizontal bar to lock said end portions of said horizontal bar relative to said hollow tubes; and wherein each of said support units is bifurcated at said intermediate portion to form front and rear foot rods, said front foot rod extending downwardly and frontwardly, said rear foot rod extending downwardly and rearwardly.

4. The swing frame of claim 3, wherein said front foot rod is formed as one piece with said intermediate portion, said rear foot rod is welded to said intermediate portion, each of said support frame units further including a secondary locking device which includes a pair of substantially T-shaped clamp plates sandwiching and clamping together said front and rear foot rods and said intermediate portion, said clamp plates having two complementing upward curved plate sections, two complementing downward and frontward curved plate sections, and two complementing downward and rearward curved plate sections.

* * * * *